US010625830B2

(12) United States Patent
Lenchner et al.

(10) Patent No.: US 10,625,830 B2
(45) Date of Patent: Apr. 21, 2020

(54) MEASUREMENT DEVICE FOR USE WITH TRACTION PAD AND TRACTION PAD INCLUDING THE SAME

(71) Applicants: Or Lenchner, Ra'anana (IL); Eran Brill, Ra'anana (IL)

(72) Inventors: Or Lenchner, Ra'anana (IL); Eran Brill, Ra'anana (IL)

( * ) Notice: Subject to any disclaimer, the term of this patent is extended or adjusted under 35 U.S.C. 154(b) by 0 days.

(21) Appl. No.: 16/232,258

(22) Filed: Dec. 26, 2018

(65) Prior Publication Data

US 2019/0193822 A1 Jun. 27, 2019

Related U.S. Application Data

(60) Provisional application No. 62/610,361, filed on Dec. 26, 2017.

(51) Int. Cl.
*B63B 35/85* (2006.01)
*B63B 35/79* (2006.01)

(52) U.S. Cl.
CPC ..... *B63B 35/85* (2013.01); *B63B 35/7906* (2013.01); *B63B 2211/00* (2013.01)

(58) Field of Classification Search
CPC ..... B63B 35/85; B63B 2211/00
See application file for complete search history.

(56) References Cited

U.S. PATENT DOCUMENTS

| | | | | |
|---|---|---|---|---|
| 5,460,558 | A * | 10/1995 | Woodstock | B63B 35/7936 280/14.21 |
| 5,766,051 | A * | 6/1998 | Messer | A63C 5/00 441/65 |
| 6,499,758 | B1 * | 12/2002 | Fournier | A63C 5/003 280/11.14 |
| 7,316,597 | B2 * | 1/2008 | Skedeleski | B63B 35/7936 441/65 |
| 7,867,050 | B2 * | 1/2011 | Crispin | B63B 35/85 441/74 |
| 9,045,202 | B1 * | 6/2015 | Alarcon | G01C 21/203 |
| 9,290,245 | B2 * | 3/2016 | Bishop | B63B 35/79 |
| 10,200,522 | B2 * | 2/2019 | Berggren | H04M 1/72527 |
| 2009/0270002 | A1 * | 10/2009 | Crispin | B63B 35/85 441/74 |
| 2019/0193822 | A1 * | 6/2019 | Lenchner | B63B 35/7906 |

* cited by examiner

*Primary Examiner* — S. Joseph Morano
*Assistant Examiner* — Jovon E Hayes
(74) *Attorney, Agent, or Firm* — Maier & Maier, PLLC

(57) ABSTRACT

A measurement device for use with a traction pad. The measurement device may include a first container configured to hold a sensor, the first container including an opening connecting an inner side of the first container with an outer side, a second container configured to hold a processor, a watertight passage between the first and second containers which allows a signal communication between the sensor and the processor, a lid configured to seal the first and second containers, a power supply configured to supply power to the processor, and a switch disposed on an end of the measurement device which is accessible to a user.

12 Claims, 5 Drawing Sheets

MEASUREMENT DEVICE FOR USE WITH TRACTION PAD AND TRACTION PAD INCLUDING THE SAME

CROSS-REFERENCE TO RELATED APPLICATION

The present patent application claims benefit and priority to U.S. Provisional Patent Application No. 62/610,361 (EFS ID 31331607) entitled "MEASUREMENT DEVICE FOR USE WITH TRACTION PAD AND TRACTION PAD INCLUDING THE SAME" filed on Dec. 26, 2017 which is hereby incorporated by reference into the present disclosure.

BACKGROUND

Traction pads, also known as tail pads, are structures designed to be attached to the back ends of surfboards, longboards, and stand-up paddle boards, etc., to stop a surfer's back foot from sliding off. According to the structure of the traction pads such as are well-known in the art, a raised section, known as a kicktail, is disposed at the back of the pad; this raised section can serve to prevent a surfer's back foot from sliding too far back on the surfboard or sliding off the board completely. Particularly, the kicktail often has a bump provided in a sine curve shape, a semi-sine curve shape and the like for aesthetic merits and user comfort, and is integrated with the traction pad as a one-piece made from materials such as foam or rubber.

Other structures having other functionality may also be attached to a surfboard. For example, in some circumstances, it may be desirable to know the surfing session parameters such as the number of waves, speed and surf length, and environmental data, such as water temperature, salinity, etc. To this end, sensors for tracking motion and measuring other surfing session parameters have been developed. However, these sensors usually require mounting to the surfboard, or require that the surfer wear them personally, which can be inconvenient. Further, if the sensors are mounted to the surfboard, the sensors will stick out from and alternate the smooth contour of the surfboard, which may have an aesthetically undesirable effect. Further, the protruding mounting support for the sensors may accidentally cause cuts or scrapes through the skin.

SUMMARY

According to an exemplary embodiment, there may be provided a traction pad that allows a measurement device to be accommodated therein. Such a traction pad may include a raised portion at an end of the traction pad, wherein the raised portion may have a through hole extending along a length direction of the raised portion. The traction pad may further include a measurement device secured within the through hole. The measurement device may include a first container configured to hold one or more sensors, the first container including an opening connecting an inner side of the first container with an outer side, a second container configured to hold a processor and a memory, a watertight passage between the first and second containers which allows a signal communication between the sensor and the processor, a lid configured to seal the first and second containers, a power supply configured to supply power to the processor, and a switch disposed on an end of the measurement device which is accessible to a user.

In one exemplary embodiment, the measurement device may further include a third container configured to hold the power supply.

In another exemplary embodiment, the measurement device may further include a fourth container sealed by a detachable lid disposed on an end of the measurement device which is accessible to the user.

In another exemplary embodiment, the processor may be configured to:

a. set the measurement device in a passive mode in response to the sensor detecting no water;

b. in response to the sensor detecting water, set the measurement device in an active mode after a predetermined number of measurements in each of which the sensor detects water;

c. record measurement data in the memory when the measurement device is in the active mode; and d. provide the measurement data to the user.

According to another exemplary embodiment, there may be provided a measurement device for use with a traction pad. The measurement device may include a first container configured to hold a sensor, the first container including an opening connecting an inner side of the first container with an outer side, a second container configured to hold a processor, a watertight passage between the first and second containers which allows a signal communication between the sensor and the processor, a lid configured to seal the first and second containers, a power supply configured to supply power to the processor, and a switch disposed on an end of the measurement device which is accessible to a user.

In one exemplary embodiment, the measurement device may be secured within a through hole disposed in a raised portion at an end of a traction pad.

In another exemplary embodiment, the measurement device may be secured underneath an end of a traction pad with a substantially uniform thickness.

In one exemplary embodiment, the measurement device may further include a third container configured to hold the power supply.

In another exemplary embodiment, the measurement device may further include a fourth container sealed by a detachable lid disposed on an end of the measurement device which is accessible to the user.

In another exemplary embodiment, the processor may be configured to:

a. set the measurement device in a passive mode in response to the sensor detecting no water;

b. in response to the sensor detecting water, set the measurement device in an active mode after a predetermined number of measurements in each of which the sensor detects water;

c. record measurement data in the memory when the measurement device is in the active mode; and d. provide the measurement data to the user.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
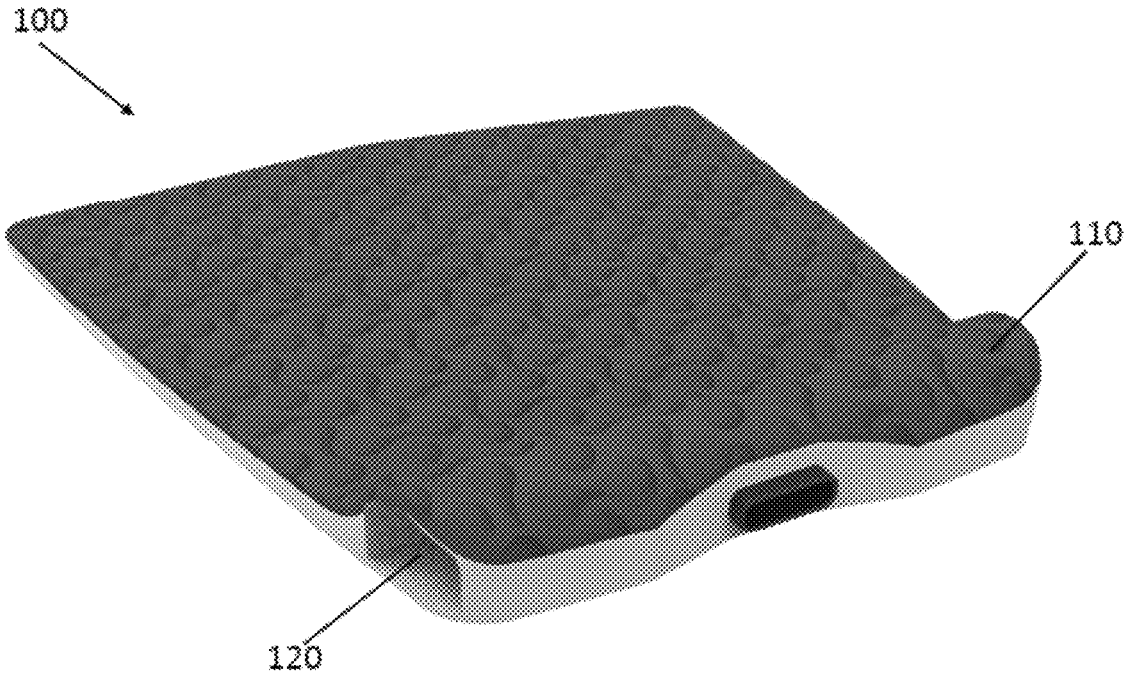
FIG. 1 is an exemplary embodiment of a traction pad that allows for accommodating a measurement device.

FIG. 1 is an exemplary embodiment of a traction pad 100 that allows for accommodating a measurement device. During use, the traction pad 100 may be affixed to a surfboard, a longboard, a stand-up paddle board, or the like, for example, by an adhesive or by another connection such as may be desired. Specifically, the traction pad 100 may include a raised portion 110 provided at an end of the traction pad 100. The raised portion 110, known as a kicktail, may operate to help prevent a surfer's back foot from sliding too far back on the surfboard or sliding off the board completely. Further, the raised portion 110 may have a through hole 120 extending along a length direction of the raised portion 110. As clearly shown in FIG. 1, the raised portion 110 may have a long profile generally. The length direction may generally be the direction in which the raised portion 110 extends on the traction pad 100.

It will be appreciated by those skilled in the art that the traction pad 100 may be made from foam, rubber or any other suitable materials. It will also be appreciated by those skilled in the art that the through hole 120 can be formed by any suitable process. For example, the through hole 120 may be formed by cutting materials from the raised portion 110. Alternatively, the through hole 120 may be formed during a molding process; for example, a slider or other insert or set of inserts may be inserted into the mold to occupy the space of the through hole 120.

Figure 2:
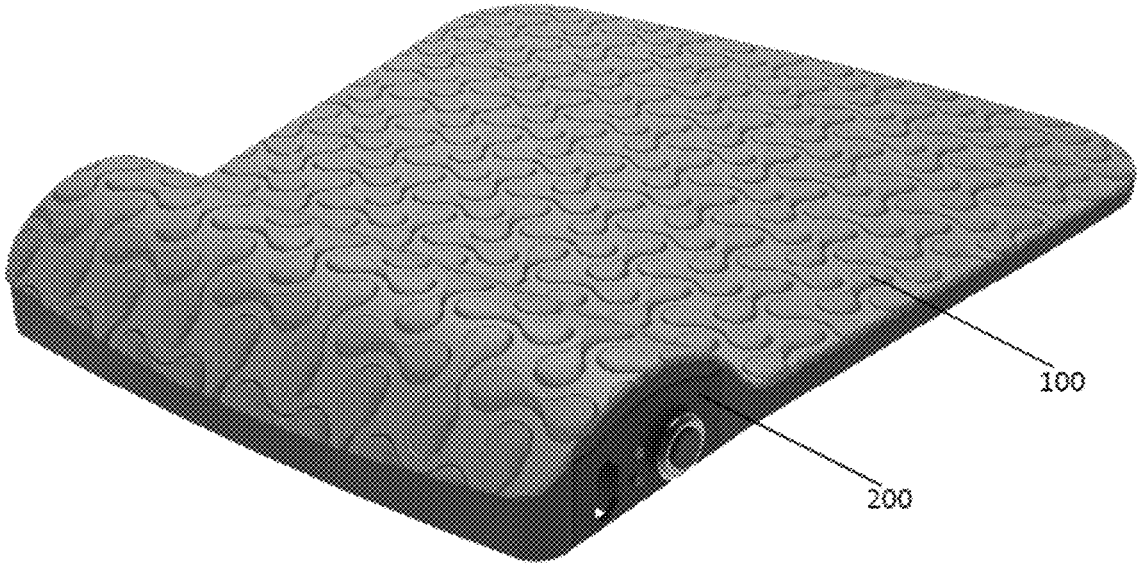
FIG. 2 is an exemplary embodiment of a measurement device used with a traction pad.

FIG. 2 may be an exemplary embodiment of a measurement device 200 used with a traction pad 100. As shown in FIG. 2, the measurement device 200 may be secured within the through hole 120 of the traction pad 100. Preferably, the measurement device 200 may be detachably secured within the through hole 120 so that the measurement device 200 can be detached from the traction pad 100 for maintenance or replacement.

It will be appreciated by those skilled in the art that the measurement device 200 may be secured within the through hole 120 by interference fit, friction force, or any other such configuration. For example, the match between the measurement device 200 and the through hole 120 may be an interference fit. In other words, the profile of the measurement device 200 may be slightly larger than that of the through hole 120. The raised portion 110 may thus resiliently accommodate the measurement device 200 when the measurement device 200 is pushed through the through hole 120.

Figure 3:
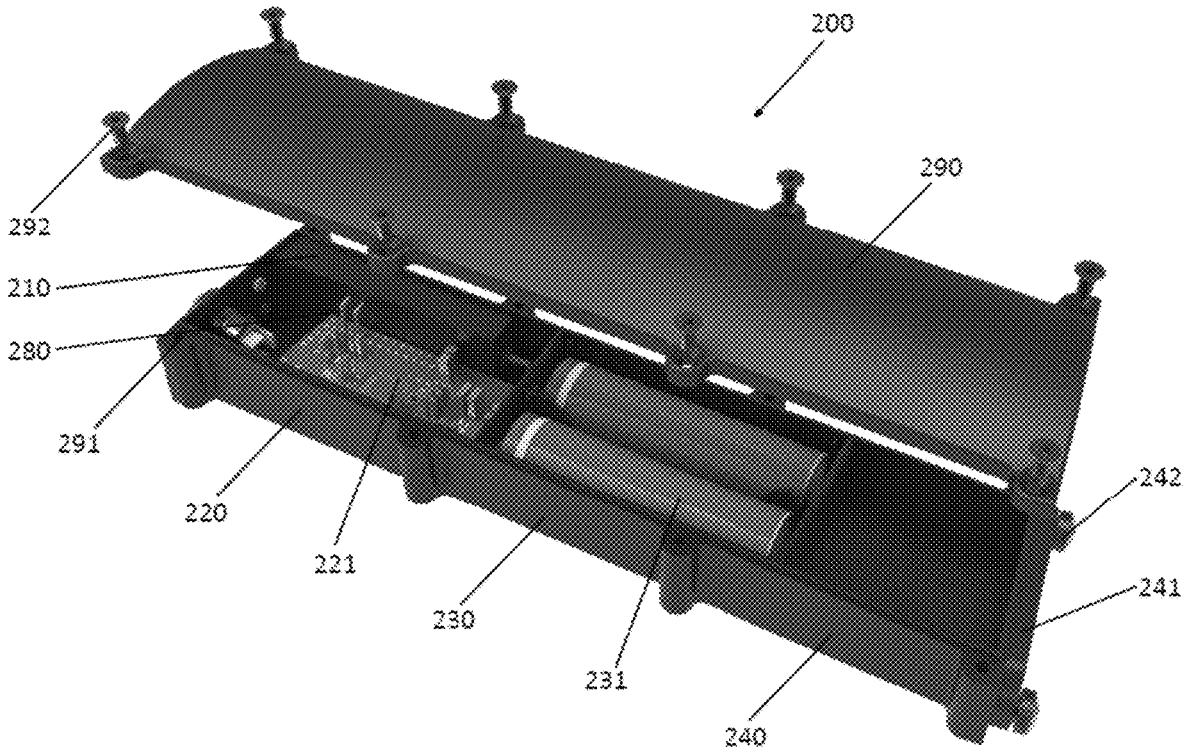
FIG. 3 is an exploded view of the exemplary embodiment of a measurement device.
Figure 7:
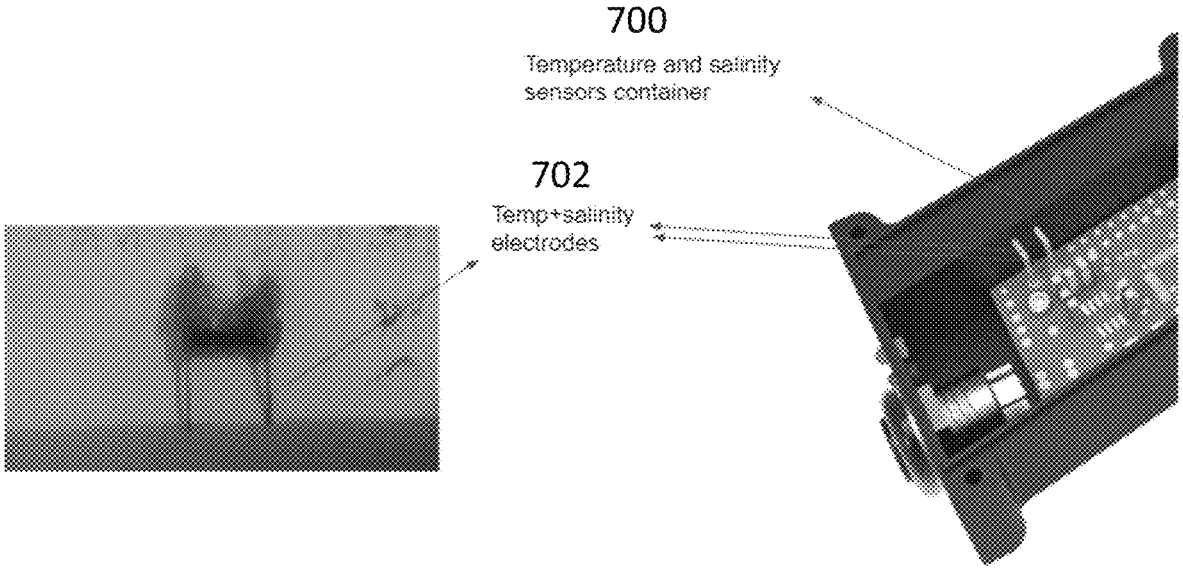
FIG. 7 is an exemplary embodiment of a container used in a measurement device.

FIG. 3 may be an exploded view of the exemplary embodiment of a measurement device 200. In the exemplary embodiment, the measurement device 200 may include a first container 210 configured to hold a sensor (not shown in the figure). As most clearly shown in the upward view in FIG. 5, the first container 210 may include an opening 211 connecting an inner side of the first container 210 with an outer side so that the sensors held within the first container 210, for example, a salinity sensor, a temperature sensor, a light sensor, or any other such sensor or combination of sensors, etc., can be in contact with the substance (water, air, etc.) to be tested. This may be seen, for example, in FIG. 7. In this exemplary figure, temperature and salinity sensors container 700 may allow for temperature and/or salinity sensors to be utilized so as to contact the water. Here, temperature and salinity electrodes 702 may be such that a watertight seal is formed about them so that water does not enter container 700, but the electrodes 702 may extend therethrough to act in their desired fashions.

Still referring to FIG. 3, the measurement device 200 may further include a second container 220 configured to hold a processor and a memory, a watertight passage 280 between the first and second containers 210, 220 which allows a signal communication between the sensor and the processor. In one exemplary embodiment, the watertight passage 280 may be provided by a hole on the wall between the first and second containers 210, 220 through which the cable of the sensor passes, and sealing material such as silicone filling any gap between the cable and the hole.

Figure 4:
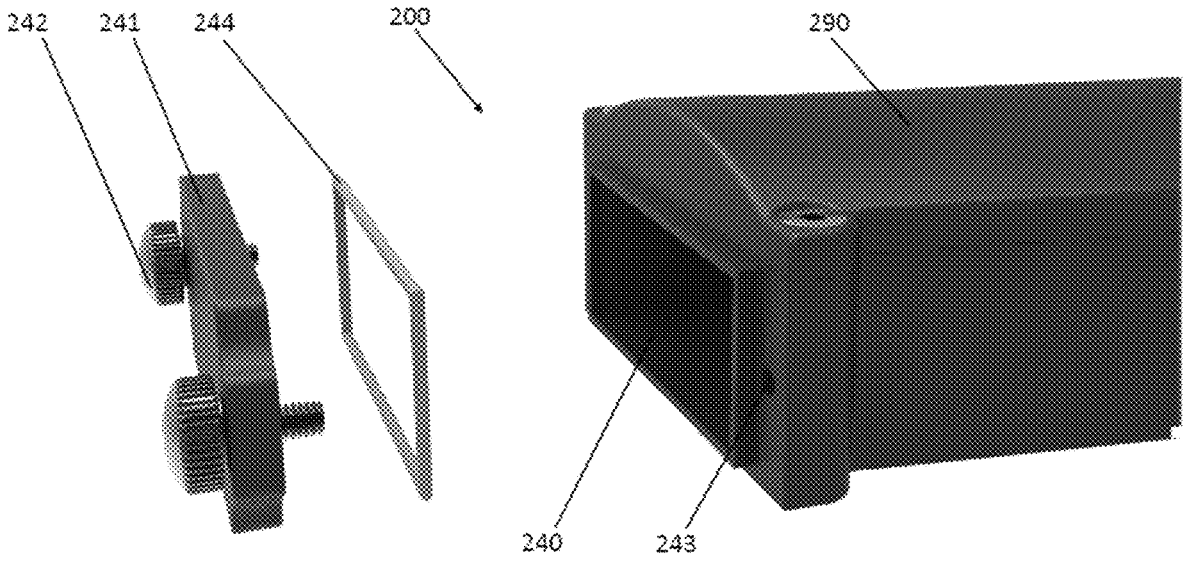
FIG. 4 is a partial view of the exemplary embodiment of a measurement device.

Still referring to FIG. 3, the measurement device 200 may further include a third container 230 configured to hold a power supply 231, for example, removable and rechargeable batteries, for supplying power to the sensor and the processor, and a fourth container 240 sealed by a detachable lid 241 which may be most clearly shown in FIG. 4.

During use, the measurement device 200 may be sealed by the lid 290. The lid 290 may be fixed by driving a plurality of screws 292 into corresponding screw holes 291. For waterproofing purposes, there may be provided an O-ring between the lid 290 and the underlying part. In this way, the measurement device 200, except for the first container 210, may be waterproof.

A principle advantage of the measurement device 200 may be that it does not stick out from or alter the smooth contour of the surfboard, since it may be accommodated within the traction pad 100.

Another advantage of the measurement device 200 may be that it provides a fourth container 240 permitting the user to put small items such as cash, car keys, or locker keys in it. In operation, the detachable lid 241 may be detachably fixed by driving the bolts 242 into corresponding holes 243. The O-ring 244 between the lid 241 and the frame of the fourth container 240 may provide waterproofing. The detachable lid 241 may be accessible when the measurement device 200 is inserted within a traction pad 100.

Figure 5:
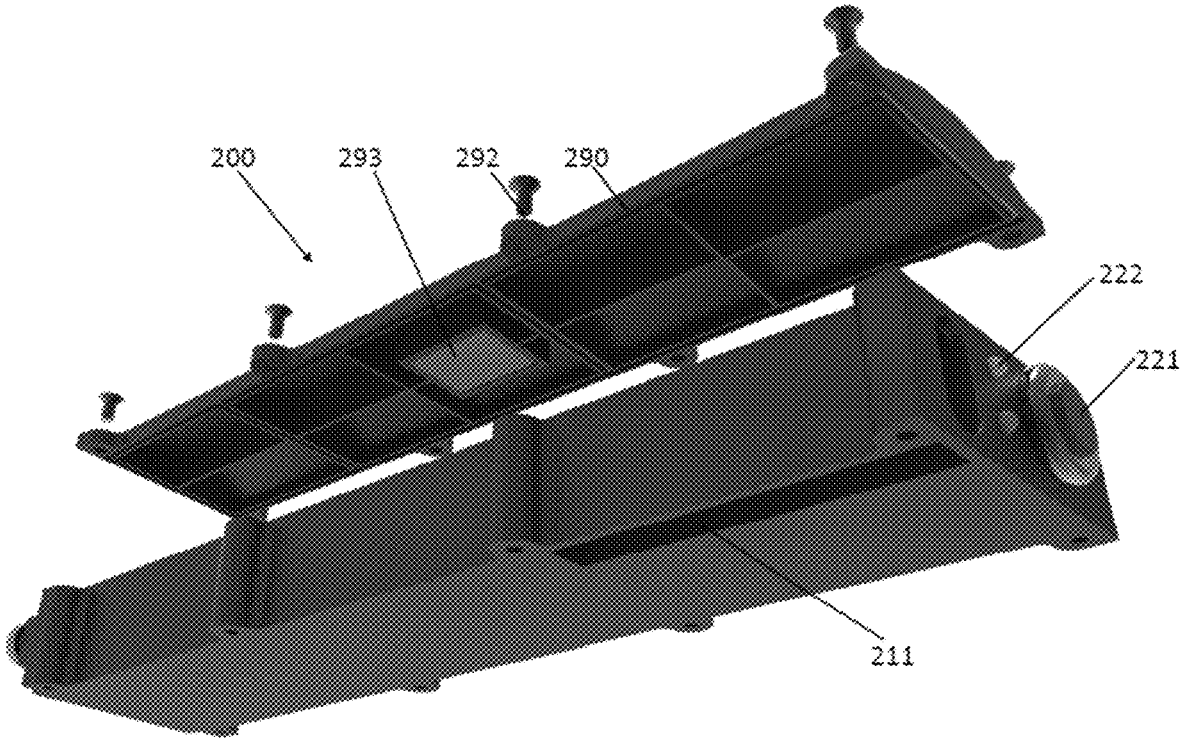
FIG. 5 is an exploded upward view of the exemplary embodiment of a measurement device.

Now turning to FIG. 5, FIG. 5 may show an exploded upward view of an exemplary embodiment of the measurement device 200. In the exemplary embodiment, the side of the lid 290 which is facing the interior the measurement device 200 after fixing may be partitioned into compartments. The compartments may provide further spaces for sensors, such as a gyroscope 293, a barometer, a magnetometer, a GPS sensor and antenna which may be kept from water.

Still referring to FIG. 5, the measurement device 200 may further include a switch 221 which allows user to control the device 200 and led lights 222 for indicating a status of the device 200.

An exemplary work routine of the processor may include performing the steps of:

a. set the measurement device in a passive mode in response to the sensor detecting no water;

b. in response to the sensor detecting water, set the measurement device in an active mode after a predetermined number of measurements in each of which the sensor detects water, which may ensure that the detection is not due to any kind of noise or random water splash. The predetermined number of measurements can be, for exemplary embodiment, 5, 10, etc.

c. record measurement data in the memory when the measurement device may be in the active mode. In some exemplary embodiments, the measurement data may be joined into blocks which may include salinity data, temperature data, coordinates data, etc. One memory block may contain, for example, data from a certain number of sensor measurements from one or more of the sensors, such as, for example, 40 gyroscope measurements. Further, at this time, a real time clock integrated into the system can add a time stamp for each measurement, sample, reading, or the like.

d. inform the user the measurement data. In an exemplary embodiment, this may be done by utilizing a Bluetooth Low Energy (BTLE) module or other wireless communications device. By such a module, the user can configure the measurement device via mobile application and the measurement device can send data to the user's mobile phone. In an exemplary embodiment, the BTLE module may be turned off unless the user turns it on manually by pressing a button. The measurement device may become visible once the BTLE module is turned on and may be connected to a mobile phone or tablet upon authorization. In an exemplary embodiment, the measurement device 200 may also be connected to another sensor or measurement device on the same board or on another board via the Bluetooth Low Energy (BTLE) module. It may be appreciated that any other data transfer and connectivity protocols, such as Wi-Fi, may also be utilized. For example, the measurement device 200 may be able to connect to an action camera on the board. The action camera may have video tagging option embedded to the camera and controlled by a button in the camera, and/or by another BLTE device. In an exemplary embodiment, the measurement device 200 may be able to have control over some elements in the action camera upon authorization, for example, over the video tagging element. It means that once the measurement device 200 recognizes an interesting event, for example, an acceleration, it will activate the video tagging feature in the action camera. The tagged video may thereafter be sent to the measurement device 200 via the BTLE module. Additionally, an output file can be generated and saved in a format, for example csv or any other desired format, and may be uploaded to one or more desired websites. In some exemplary embodiments, the output file can be uploaded to Google Earth.

Figure 6:
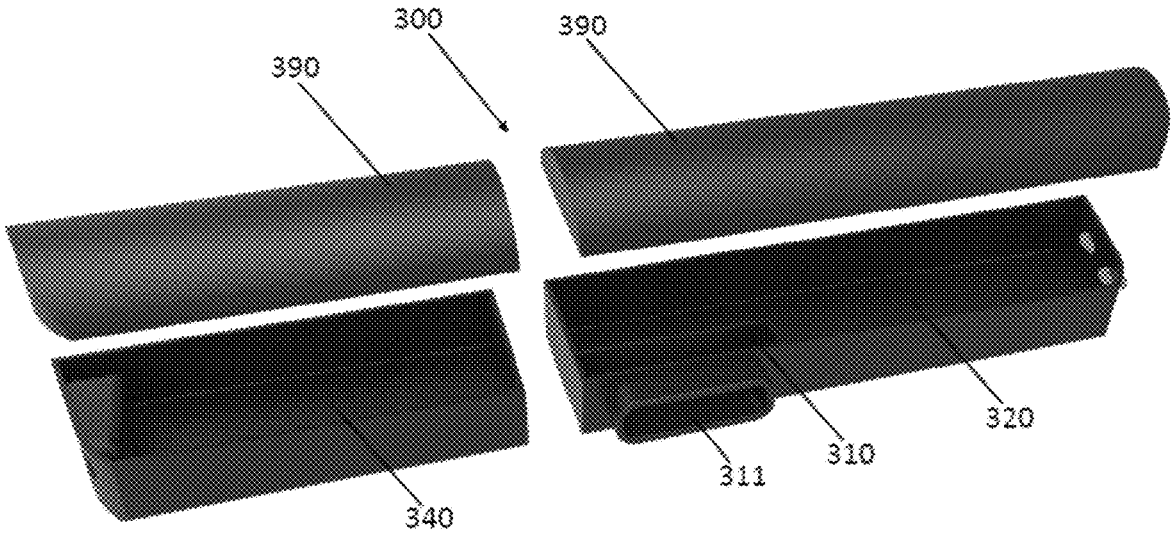
FIG. 6 is another exemplary embodiment of a measurement device for use with a traction pad.

FIG. 6 may be another exemplary embodiment of a measurement device 300 for use with a traction pad. Comparing the exemplary embodiment of the measurement device 300 shown in FIG. 6 with the past measurement device 200, one difference between measurement devices 200 and 300 may be that the measurement device 300 is formed into two separate parts with the first and second containers 310 and 320 being disposed in right part and the fourth container 340 in the left part. The measurement device 300 may be suitable for being disposed within a styled traction pad, for example, when the traction pad has a slightly "V" shaped raised portion (having a valley between raised parts of the raised portion) instead of having a continuous or straight raised portion. One difference between measurement devices 200 and 300 may be that the opening 311 connecting an inner side of the first container 310 with an outer side may be disposed on a protrusion from the front side of the container 310. Referring to FIG. 1, after mounting, the protrusion may protrude beyond the traction pad 100.

It should be appreciated that the forgoing embodiments are intended as merely illustrative, and not as limiting.

Although the lid 290 may be fixed by screws, the lid may alternatively be fixed by any alternative connector or combination of connectors, for example, by clamps, snap-down locking hinges, etc.

Further, although the processor and memory and other peripheral circuits are shown as being assembled on a printed circuit board, they can take the manner of system on chip (SOC) or any other suitable manner.

Further, although the power supply 231 may be shown as batteries, any other suitable power supplying devices can be applied, for exemplary embodiment, solar pads.

Further, although the power supply 231 may be shown as being held in the separate third container 230, it can be held in the second container 220 and the third container 230 can be saved.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for exemplary embodiment, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A traction pad and measurement device comprising:

a traction pad, the traction pad having a void disposed therein;

a measurement device housing having at least one compartment disposed therein, the measurement device housing being configured to fit in the void of the traction pad;

at least one sensor, the at least one sensor being disposed within a compartment of the measurement device housing; and a first compartment formed within the measurement device housing, wherein the first compartment has an opening to an exterior of the measurement device housing, the opening being configured to allow a sensor to contact an exterior substance.

2. The device of claim 1, further comprising a sealable compartment disposed in the measurement device housing, wherein the sealable compartment is accessible when the measurement device is disposed within the void of the traction pad.

3. The device of claim 1, wherein the at least one sensor is at least one of a gyroscope, a barometer, a magnetometer, a GPS sensor and antenna, a temperature sensor, light sensor, and a salinity sensor.

4. The device of claim 1, wherein the void in the traction pad is disposed below a raised portion of the traction pad.

5. The device of claim 1, further comprising a processor disposed in a second compartment, the processor being communicatively coupled to the at least one sensor, wherein the second compartment is watertight.

6. The device of claim 5, wherein the communicative coupling is hardwired through an opening connecting the first compartment with the second compartment, and wherein the opening is sealed around the hardwiring to be watertight.

7. The device of claim 5, further comprising a power supply, the power supply being disposed in one of the second compartment or a third compartment within the measurement device housing.

8. The device of claim 1, further comprising a wireless communication device for at least one of communicating data to an external device and receiving commands from an external device.

9. The device of claim 1, wherein the measurement device housing is watertight.

10. The device of claim 1, further comprising a power switch on the measurement device housing, wherein the power switch is accessible when the measurement device housing is disposed within the traction pad void.

11. The device of claim 1, wherein the device activates upon detecting contact with water by the at least one sensor.

12. The device of claim 1, wherein the device is configured to interface with at least one external camera device.

* * * * *